US007183988B2

(12) United States Patent
Piltonen

(10) Patent No.: US 7,183,988 B2
(45) Date of Patent: Feb. 27, 2007

(54) DIRECTIONAL ANTENNA MECHANISM

(75) Inventor: Harri Piltonen, Varjakka (FI)

(73) Assignee: Tracker OY, Oulunsalo (FI)

( * ) Notice: Subject to any disclaimer, the term of this patent is extended or adjusted under 35 U.S.C. 154(b) by 0 days.

(21) Appl. No.: 11/055,603

(22) Filed: Feb. 11, 2005

(65) Prior Publication Data

US 2005/0184918 A1 Aug. 25, 2005

(30) Foreign Application Priority Data

Feb. 11, 2004 (FI) ..... 20040207

(51) Int. Cl.
*H01Q 3/00* (2006.01)

(52) U.S. Cl. ..... 343/757; 343/882

(58) Field of Classification Search ..... 343/881–882, 343/754–757, 729

See application file for complete search history.

(56) References Cited

U.S. PATENT DOCUMENTS

| | | | | |
|---|---|---|---|---|
| 3,392,399 | A * | 7/1968 | Winegard | 343/815 |
| 3,409,892 | A | 11/1968 | Mooney, Jr. | 343/713 |
| 3,453,630 | A * | 7/1969 | Thompson | 343/757 |
| 3,564,551 | A * | 2/1971 | Mills et al. | 343/747 |
| 3,665,477 | A * | 5/1972 | Budrow et al. | 343/714 |
| 3,725,945 | A * | 4/1973 | Lockwood | 343/882 |
| 3,745,581 | A * | 7/1973 | Lockwood | 343/730 |
| 3,860,932 | A * | 1/1975 | Hochbrueckner | 343/713 |
| 4,293,861 | A * | 10/1981 | Winegard et al. | 343/766 |
| 4,626,866 | A | 12/1986 | Lindberg | 343/880 |
| 5,886,672 | A * | 3/1999 | Brune et al. | 343/792.5 |
| 5,966,104 | A | 10/1999 | Massey et al. | 343/915 |
| 5,995,809 | A * | 11/1999 | Kobayashi | 455/575.7 |
| 2003/0071762 | A1* | 4/2003 | Tulloch | 343/882 |
| 2004/0252067 | A1* | 12/2004 | Royalty | 343/757 |
| 2005/0259021 | A1* | 11/2005 | Stoyanov et al. | 343/757 |

FOREIGN PATENT DOCUMENTS

| | | |
|---|---|---|
| FI | 113217 B | 4/2002 |
| GB | 371476 | 4/1932 |
| WO | WO 99/28881 | 6/1999 |

* cited by examiner

*Primary Examiner*—Hoang V. Nguyen
*Assistant Examiner*—Tung Le
(74) *Attorney, Agent, or Firm*—Young & Thompson

(57) ABSTRACT

A directional antenna mechanism of a mobile radio tracking receiver, includes four antenna elements pivotably fastened to the body of the receiver. In use, the elements are turned to an operating position, in which they are pointed away from the body. After use, the elements can be turned to a transport position, in which they are placed inside the body in the direction of its longitudinal axis. At least two elements are connected to each other by a mechanism such that moving the first antenna element to the operating transport position also causes the second antenna element to move to the same position simultaneously. The mechanism includes a movable transmission rod inside the body, with toothings and toothed discs fastened to the ends of the elements, contacting the toothings. The rod is moved either manually by a lever fastened to the rod or by an actuator arranged inside the body.

16 Claims, 2 Drawing Sheets

DIRECTIONAL ANTENNA MECHANISM

BACKGROUND OF THE INVENTION

The invention relates to a directional antenna mechanism of a mobile radio tracking receiver, comprising four antenna elements, which are fastened as articulated to the body of the radio tracking receiver, where the electronic components and devices of the tracking receiver are placed inside the body, and where the antenna elements are turnable to an operating position in which they are pointed away from the body and to a transport position in which they are placed substantially parallel to the direction of the longitudinal axis of the body.

Portable, hand-held radio tracking receivers are often utilized in positioning systems. This positioning method is based on there being a radio transmitter sending a radio signal in the target being positioned. The receiver is used to determine from which direction the radio signal is coming, whereby it is known in which direction the target being positioned is. Radio tracking systems are used, among other things, in various emergency positioning systems, in the positioning of pets and hunting animals and in the positioning of hikers, hunters and inmates of institutions.

The ability of a radio tracking receiver to determine the incoming direction of the radio signal is based on a directional antenna in the receiver. A directional antenna has the basic property that it receives a radio signal well when the antenna is directed straight towards the radio transmitter sending the signal. A signal coming from other directions is attenuated by the directional antenna. The dimensions of the directional antenna depend on the radio frequency used. The antenna used in the mobile tracking receivers on the market today is generally a so-called Yagi antenna with 2 or 3 elements. The directional antenna is often integrated into the same body with the radio receiver in order to create an easy-to-use and small-sized hand-held radio tracking receiver.

Directional antennas generally include four separate, elongated antenna elements, which can be arranged in the body of the radio receiver in many different ways. One way is to fasten the antenna elements at one end as hinged to the body in a way that they can be bent to a operating position, in which the antenna elements are pointed away from the body, and to a transport position, in which the antenna elements are placed in the direction of the body and against it. Turning the hinged antenna elements one by one to the right position manually is a slow procedure. In addition, the antenna elements can remain in a faulty position, in which case the device does not function as intended or it can give incorrect tracking results. There are also prior art devices in which the hinged antenna elements are arranged to open by spring force. However, such a device is inconvenient and even dangerous in use, because when the device is set in the operating position, the antenna elements fling out with great speed. In addition, it is difficult to fold the antenna elements back to the transport position manually, because the spring force pushes the antenna elements into the opposite direction.

The antenna elements can also be telescopic, in which case they are inside the body in the transport position. In the using situation, the antennas are drawn out from the body manually one by one, and therefore the opening of telescope antennas takes place slowly. The antennas can easily remain incompletely drawn to the correct length, in which case the tracking result can become incorrect. In addition, the mechanic durability of telescope antennas is poor.

There is also a prior art mobile radio receiver, in which some of the antenna elements are embedded in the body of the device and some in an openable lid in the device. The device is set ready for operation by opening the lid. Such a radio receiver has to be made relatively large so as to make the antenna elements fit inside the body and the lid in the spread position. In addition, the electronic components of the receiver part in the body of the device are located between the antenna elements, which disturb the operation of the antenna and may cause faulty indications and a deterioration of the receiving ability.

The reference publication GB 371 476 discloses a directional antenna mechanism especially suited for submarines, comprising a pipe-like support part, which is fastened as hinged to the body of the vessel. The reference publication U.S. Pat. No. 3,409,892 discloses a foldable antenna arrangement installed in a vehicle, comprising two transmission antennas and two reception antennas. The solutions described in the above reference publication are large-sized and are thus not suitable for use in small-sized, mobile radio tracking devices.

The purpose of the invention is to disclose a directional antenna mechanism with a new kind of structure, by which the drawbacks and disadvantages related to the prior art directional antennas of the radio tracking receivers can be significantly reduced.

SUMMARY OF THE INVENTION

The invention relates to a directional antenna mechanism of a mobile radio tracking receiver, comprising four antenna elements, which are fastened by a pivot pin to the body of the radio tracking receiver. The electronic components and devices of the tracking receiver are placed inside the body. When the radio tracking receiver is used, the antenna elements are turned to an operating position, in which they are pointed away from the body. After use, for the duration of transport and storage, the antenna elements can be turned to a transport position, in which they are placed substantially parallel to the direction of the longitudinal axis of the body. The basic idea of the invention is that at least two antenna elements are connected to each other by a mechanism in a way that moving the first antenna element to the operating position or the transport position also causes the second antenna element to turn to the same operating position or transport position simultaneously.

In a preferred embodiment of the invention, all the antenna elements are connected to each other by a mechanism in a way that moving one antenna element to the operating position or the transport position causes all the antenna elements to turn to the same operating position or transport position simultaneously. Preferably, in the transport position, the antenna elements are arranged to turn into the body through openings in the wall of the body.

In another preferred embodiment, the mechanism comprises a movable transmission rod arranged inside the body, with toothings and toothed discs fastened at the ends of the antenna elements, which contact to the toothings of the transmission rod, and means for moving the transmission rod. Preferably the means for moving the transmission rod comprise a lever fastened to the transmission rod, which reaches outside the wall of the body.

In a third preferred embodiment of the invention, the means for moving the transmission rod comprise an actuator connected to the transmission rod and a switch for controlling the actuator. The actuator is preferably an electric motor or a solenoid.

The invention has the advantage that it quickens and facilitates changing the position of the antenna elements, whereby the device can be set to the operating position and the transport position more quickly.

In addition, the invention has the advantage that due to the mechanism, the antenna elements always turn to the correct position in the operating position, in which case tracking errors caused by an incorrect position of the antenna elements cannot occur.

A further advantage of the invention is that the mechanism is simple, reliably functioning and has low manufacturing costs.

BRIEF DESCRIPTION OF THE DRAWINGS

In the following, the invention will be described in more detail. Reference will be made to the accompanying drawings, in which.

DETAILED DESCRIPTION OF THE PREFERRED EMBODIMENTS

Figure 1A:
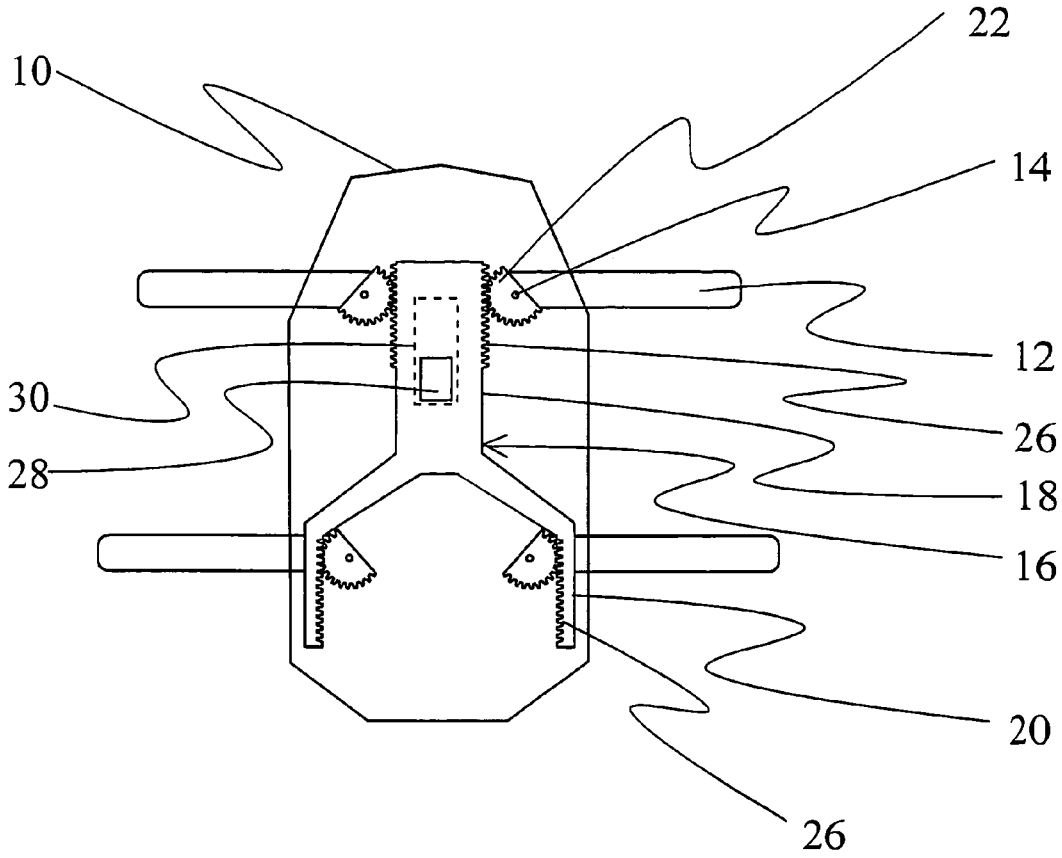
FIGS. 1*a* and 1*b* show an example of a directional antenna fitting according to the invention as seen from above.
Figure 1B:
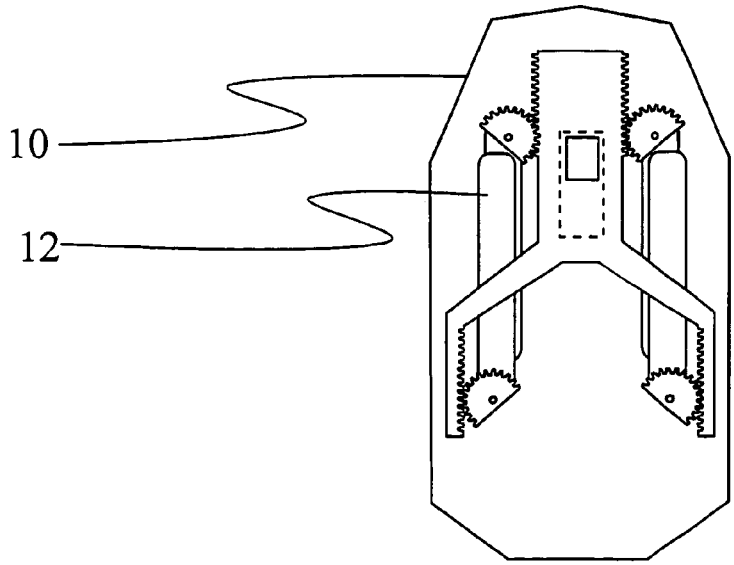

FIGS. 1*a* and 1*b* show an example of the directional antenna mechanism of a mobile radio tracking receiver intended to be held in the hand according to the invention as seen from above. FIG. 1*a* shows the directional antenna mechanism in the operating position and FIG. 1*b* the same mechanism in the transport position. In the invention, the directional antenna mechanism comprises four elongated antenna elements 12, which are fastened at their first end to the body 10 of the radio tracking receiver by a pivot pin 14. The antenna elements are placed in the body by pairs in a way that the first and the second directional antenna are set side by side close to the first end of the body, and the third and the fourth directional antenna side by side close to the second end of the body. The antenna elements are placed on different levels inside the body so that the first and the second element are on the same level, and the third and the fourth element on the same level. In this way, the antenna elements are arranged partly on top of each other inside the body in the transport position. The antenna elements have been implemented by using the conventional prior art technology used in directional antennas, and therefore their structure is not described in more detail in this specification. In the figures, the body of the radio tracking receiver is shown as a cross-section on the level of the antenna elements so that the directional antenna mechanism is visible. In practice, the electronic components and devices belonging to the radio tracking receiver are also placed inside the body. However, they do not fall within the scope of this invention, and therefore they are not shown in the figure.

Half-circle toothed discs 22 are fastened to the ends of the antenna elements 12 in a way that the distance of the teeth on the curved edge of the toothed disc from the joint pin 14 is substantially constant. In the central area of the body 10, there is a transmission rod 16 resembling the letter Y upside down, with an arm 18 pointed towards the first end of the body and two branches 20 pointed towards the second end of the body, the first branch and the second branch. The transmission rod is fastened to the body by sliding fasteners in a way that it can move inside the body in the direction of the longitudinal axis of the body. The sliding fasteners are preferably implemented so that the free motion of the transmission rod is in the order of 10 to 20 mm. On the outer edges of the arm there is a toothing 26, in which the size and shape of the teeth corresponds to the size and shape of the teeth of the toothed discs 22 at the ends of the antenna elements 12. The arm of the transmission rod is placed between the toothed discs at the ends of the first and the second antenna element 12 so that the teeth of the toothed discs are placed against the toothing 26 of the arm. On the second surface of the branches, facing the central part of the body, there is a similar toothing 26 as in the arm. The branches are located inside the body in a way that the toothing of the first branch is placed against the toothed disc 22 of the third antenna element 12 and the toothing of the second branch is placed against the toothed disc of the fourth antenna element. All the antenna elements are thus connected to each other through the transmission rod 16.

When the transmission rod 16 is moved to its extreme position towards the first end of the body 10, the toothings 26 of the arm 18 and the branches 20 force the toothed discs 22 to turn around the pivot pins 14. At the same time, the antenna elements fastened to the toothed discs are turned out from the inside of the body to the operating position, in which the other ends thereof are pointed away from the body (FIG. 1*a*). Naturally, there are openings in the wall of the body for each antenna element (not shown in the figure), through which the antenna elements can be turned out from the inside of the body. Correspondingly, when the transmission rod is moved to its other extreme position towards the other end of the body, the antenna elements are turned back into the body 10 to the transport position, in which the antenna elements 12 are arranged in a position substantially parallel with the longitudinal axis of the body (FIG. 1*b*). For moving the transmission rod, there is a lever 28 in the arm 18, reaching through a slot 30 in the wall of the body to the outside of the wall within the reach of the user. The user can thus quickly move the antenna elements to the operating position or the transport position simply by moving the lever 28 and the transmission rod 16 connected to it with his thumb, for example.

In addition to the lever 28, the antenna elements can be moved by gripping the end of one antenna element by a finger, for example, and by drawing the element out to the operating position. Then, at the same time, all the antenna elements turn out from the inside of the body to the operating position. Correspondingly, all the antenna elements can be turned to the transport position when a single antenna element is turned into the body manually. In order to facilitate gripping the end of the antenna element, it is possible to arrange a protruding part at the end of at least one element to stick out from the inside of the body when the antenna elements are in the transport position.

Figure 2:
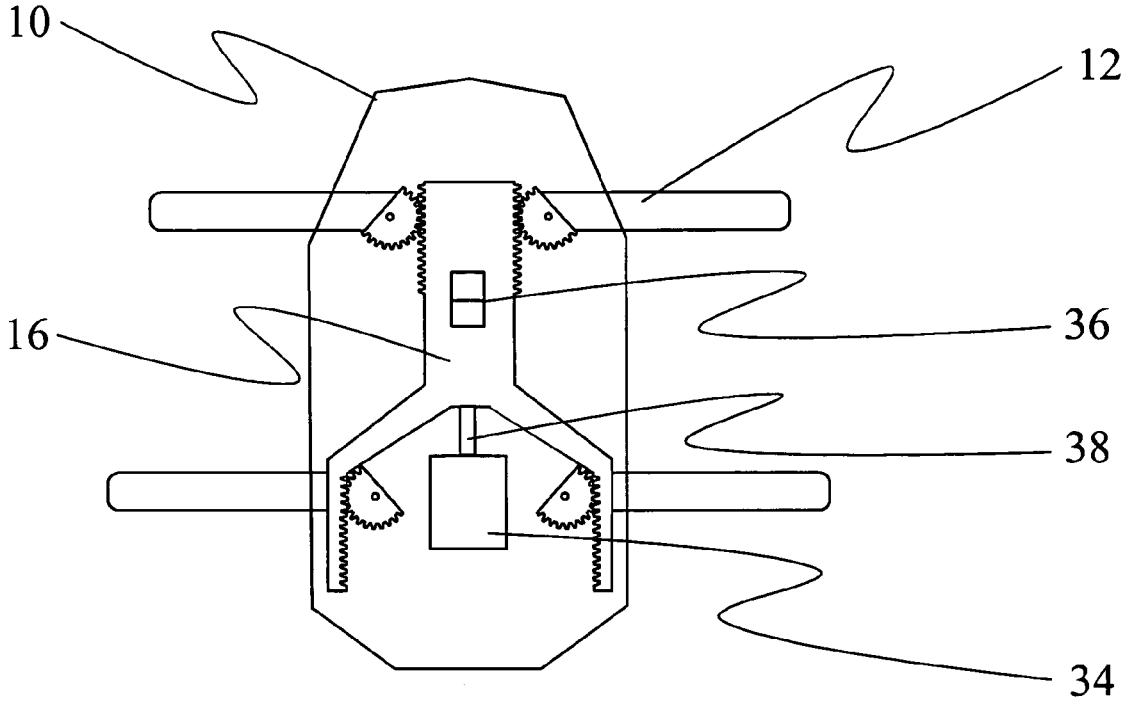
FIG. 2 shows an example of a preferred embodiment of a directional antenna mechanism according to the invention.

FIG. 2 presents a preferred embodiment of the directional antenna mechanism according to the invention. In this embodiment there is an actuator 34 inside the body, preferably an electric motor or a solenoid. The actuator is connected to the transmission rod 16 by a shaft 38 in a way that the transmission rod can be moved to its first or second extreme position by using the actuator. Then the antenna elements 12 automatically move to the operating or transport position. The actuator is controlled by a switch 36, which is placed on the outer surface of the body 10 within the reach of the user.

In another preferred embodiment of the invention, the antenna elements are coupled to each other by pairs by means of a mechanism. Then the first and the second antenna element form the first pair, and the third and the fourth antenna element form the second pair. In both pairs the antenna elements move simultaneously to the operating and transport position. This is implemented technically by dividing the transmission rod 16 into two parts in a way that the first part formed by the arm 18 and the second part formed by the branches 20 can both be moved independently. Both parts of the transmission rod must naturally have their own means for moving them.

Some preferred embodiments of the directional antenna mechanism of a mobile radio tracking device according to the invention have been described above. The invention is not limited to the solutions described above, but the inventive idea can be applied in numerous ways within the limits set by the claims.

I claim:

1. A directional antenna mechanism of a mobile radio tracking receiver, comprising four antenna elements, which are fastened as articulated to a body of the radio tracking receiver, where electronic components and devices of the tracking receiver are placed inside the body of the receiver and where the antenna elements are turnable between an operating position in which they are pointed away from the body and a transport position in which they are placed substantially parallel to the direction of the longitudinal axis of the body, and where at least two antenna elements are connected to each other by a mechanism in a way that moving the first antenna element to the operating position or the transport position causes the second antenna element to move to the same operating position or transport position simultaneously.

2. A directional antenna mechanism according to claim 1, in which all the antenna elements are connected to each other by a mechanism in a way that moving one antenna element to the operating position or the transport position causes all the antenna elements to move to the same operating position or transport position simultaneously.

3. A directional antenna mechanism according to claim 1, in which the antenna elements are arranged to turn into the body in the transport position.

4. A directional antenna mechanism of a mobile radio tracking receiver, comprising four antenna elements, which are fastened as articulated to a body of the radio tracking receiver, where electronic components and devices of the tracking receiver are placed inside the body of the receiver and where the antenna elements are turnable to an operating position in which they are pointed away from the body and to a transport position in which they are placed substantially parallel to the direction of the longitudinal axis of the body, and where at least two antenna elements are connected to each other by a mechanism in a way that moving the first antenna element to the operating position or the transport position causes the second antenna element to move to the same operating position or transport position simultaneously wherein said mechanism comprises a movable transmission rod arranged inside the body, with toothings and toothed discs fastened to the ends of the antenna elements, contacting to the toothings of the transmission rod, and means for moving the transmission rod.

5. A directional antenna mechanism according to claim 4, in which said means for moving the transmission rod comprise a lever fastened to the transmission rod and reaching outside the wall of the body.

6. A directional antenna mechanism according to claim 4, in which said means for moving the transmission rod comprise an actuator connected to the transmission rod and a switch for controlling the actuator.

7. A directional antenna mechanism according to claim 6, in which the actuator is an electric motor or a solenoid.

8. A directional antenna mechanism of a mobile radio tracking receiver, comprising:

a radio tracking receiver body;

plural antenna elements pivotally connected to said radio tracking receiver body; and an antenna moving mechanism movable along a longitudinal axis of said radio tracking receiver body, said plural antenna elements being rotatable between an operating position in which they are pointed away from the radio tracking receiver body and a transport position in which they are substantially parallel to a longitudinal axis of the radio tracking receiver body when said antenna moving mechanism moves along said longitudinal axis.

9. The directional antenna mechanism according to claim 8, wherein at least two of said plural antenna elements are connected to each other by said antenna rotating mechanism so that moving a first one of said plural antenna elements to the operating position or the transport position causes a second one of said plural antenna elements to move to the same operating position or transport position simultaneously.

10. The directional antenna mechanism according to claim 8, wherein there are at least four of said plural antenna elements and wherein all the antenna elements are connected to each other by said antenna rotating mechanism so that moving one of said plural antenna elements to the operating position or the transport position causes all the antenna elements to move to the same operating position or transport position simultaneously.

11. The directional antenna mechanism according to claim 8, wherein the plural antenna elements turn into the radio tracking receiver body in the transport position.

12. The directional antenna mechanism according to claim 8, wherein said antenna moving mechanism is substantially Y-shaped having an arm and two branches, said arm and two branches being structured and arranged so that moving one antenna element to the operating position or the transport position causes another one of the antenna elements to move to the same operating position or transport position simultaneously.

13. The directional antenna mechanism according to claim 8, further comprising an actuating mechanism connected to said antenna moving mechanism, said antenna moving mechanism being slidable along said longitudinal axis by moving said actuating mechanism.

14. The directional antenna mechanism according to claim 13, wherein said actuating mechanism is a lever.

15. The directional antenna mechanism according to claim 13, wherein said actuating mechanism is an electric motor.

16. The directional antenna mechanism according to claim 13, wherein said actuating mechanism is a solenoid.

* * * * *